US008197306B2

(12) United States Patent
Borucki et al.

(10) Patent No.: US 8,197,306 B2
(45) Date of Patent: Jun. 12, 2012

(54) METHOD AND DEVICE FOR THE INJECTION OF CMP SLURRY

(75) Inventors: Leonard Borucki, Mesa, AZ (US); Ara Philipossian, Tucson, AZ (US); Yasa Sampurno, Tucson, AZ (US); Sian Theng, Tucson, AZ (US)

(73) Assignee: Araca, Inc., Tucson, AZ (US)

( * ) Notice: Subject to any disclaimer, the term of this patent is extended or adjusted under 35 U.S.C. 154(b) by 794 days.

(21) Appl. No.: 12/262,579

(22) Filed: Oct. 31, 2008

(65) Prior Publication Data

US 2010/0112911 A1 May 6, 2010

(51) Int. Cl.
*B24B 57/00* (2006.01)
*B24B 1/00* (2006.01)

(52) U.S. Cl. ..... 451/60; 451/446

(58) Field of Classification Search ..... 451/60, 451/446, 41, 36

See application file for complete search history.

(56) References Cited

U.S. PATENT DOCUMENTS

| | | | | |
|---|---|---|---|---|
| 3,342,652 | A | 9/1967 | Reisman et al. | |
| 4,549,374 | A | 10/1985 | Basi et al. | |
| 4,910,155 | A | 3/1990 | Cote et al. | |
| 5,216,843 | A | 6/1993 | Breivogel et al. | |
| 5,403,228 | A | 4/1995 | Pasch | |
| 5,554,064 | A | 9/1996 | Breivogel et al. | |
| 5,709,593 | A | 1/1998 | Guthrie et al. | |
| 5,873,769 | A | 2/1999 | Chiou et al. | |
| 5,964,413 | A | 10/1999 | Mok | |
| 5,997,392 | A * | 12/1999 | Chamberlin et al. | 451/446 |
| 6,019,671 | A | 2/2000 | Shendon | |
| 6,135,868 | A | 10/2000 | Brown et al. | |
| 6,193,587 | B1 | 2/2001 | Lin et al. | |
| 6,283,840 | B1 | 9/2001 | Huey | |
| 6,284,092 | B1 | 9/2001 | Manfredi | |

(Continued)

FOREIGN PATENT DOCUMENTS

JP 2008263120 A 10/2008

(Continued)

OTHER PUBLICATIONS

PCT/US2010/034975 International Search Report dated Jan. 26, 2011.

(Continued)

*Primary Examiner* — Dung Van Nguyen

(74) *Attorney, Agent, or Firm* — Schmeiser, Olsen & Watts LLP

(57) ABSTRACT

The present invention comprises an apparatus for injecting slurry between the wafer and the pad in chemical mechanical polishing of semiconductor wafers comprising a solid crescent shaped injector the concave trailing edge of which is fitted to the size and shape of the leading edge of the polishing head with a gap of up to 1 inch, the bottom surface of which faces the pad and rests on it with a light load, and through which CMP slurry or components thereof are introduced through one or more openings in the top of the injector and travel through a channel or reservoir the length of the device to the bottom where it or they exit multiple openings in the bottom of the injector, are spread into a thin film, and are introduced between the surface of the polishing pad and the wafer along the leading edge of the wafer in quantities such that all or most of the slurry is introduced between the wafer and the polishing pad and a method of use therefor.

21 Claims, 3 Drawing Sheets

U.S. PATENT DOCUMENTS

| | | | | |
|---|---|---|---|---|
| 6,312,558 | B2 | 11/2001 | Moore | |
| 6,347,979 | B1 * | 2/2002 | Drill | 451/41 |
| 6,398,627 | B1 | 6/2002 | Chiou et al. | |
| 6,429,131 | B2 | 8/2002 | Lin et al. | |
| 6,500,054 | B1 | 12/2002 | Ma et al. | |
| 6,500,055 | B1 | 12/2002 | Adams et al. | |
| 6,623,343 | B2 | 9/2003 | Kajiwara et al. | |
| 6,679,765 | B2 * | 1/2004 | Tung et al. | 451/60 |
| 6,686,284 | B2 | 2/2004 | Chung et al. | |
| 6,764,387 | B1 | 7/2004 | Chen | |
| 6,887,132 | B2 * | 5/2005 | Kajiwara et al. | 451/41 |
| 6,929,533 | B2 | 8/2005 | Chang | |
| 6,945,857 | B1 | 9/2005 | Doan et al. | |
| 6,976,902 | B2 | 12/2005 | Koo et al. | |
| 6,984,166 | B2 * | 1/2006 | Maury et al. | 451/41 |
| 7,008,302 | B2 | 3/2006 | Wu et al. | |
| 7,021,999 | B2 | 4/2006 | Jiang et al. | |
| 7,101,251 | B2 | 9/2006 | Swedek et al. | |
| 7,175,510 | B2 | 2/2007 | Skocypec et al. | |
| 7,201,634 | B1 | 4/2007 | Naujok et al. | |
| 7,857,683 | B2 | 12/2010 | Burns et al. | |
| 2002/0144371 | A1 | 10/2002 | Piombini | |
| 2002/0173240 | A1 | 11/2002 | Wang et al. | |
| 2003/0068959 | A1 | 4/2003 | Kajiwara et al. | |
| 2007/0049170 | A1 | 3/2007 | Han | |
| 2007/0224920 | A1 | 9/2007 | Nakagawa et al. | |
| 2007/0281592 | A1 | 12/2007 | Benner | |
| 2008/0113513 | A1 | 5/2008 | Baum | |
| 2010/0216373 | A1 | 8/2010 | Borucki et al. | |

FOREIGN PATENT DOCUMENTS

| | | | |
|---|---|---|---|
| KR | 20000000583 | A | 1/2000 |

OTHER PUBLICATIONS

PCT/US2010/034988 International Search Report dated Jan. 28, 2011.

PCT/US2010/060330 International Search Report dated Sep. 15, 2011.

PCT/US2010/060801 International Search Report dated Sep. 16, 2011.

* cited by examiner

METHOD AND DEVICE FOR THE INJECTION OF CMP SLURRY

BACKGROUND OF THE INVENTION

Chemical Mechanical Polishing (CMP) slurry, together with polishing pads and diamond conditioner disks form the key components of the equipment used to carry out CMP processes in recent years. These polishing pads and diamond conditioner disks have been produced and marketed by several vendors to standards of reliable quality and effectiveness. The function of the polishing pad is to cut away and polish the wafer surface in conjunction with the slurry. As they accomplish this function, the polishing pads themselves become smooth and lose effectiveness in their capacity to polish the wafer surface. The function of the diamond conditioner discs, the surface facing the polishing pad of which is covered with small embedded diamonds or other hard substance, is to cut into and roughen the polishing pad surface during polishing so that it is continually being roughened as the wafer smooths it. This way the effectiveness of the polishing pad is maintained constant. The function of the slurry is to deliver continuously the mechanical abrasive particles and chemical components to the surface of the wafer and to provide a means of removing reaction products and wafer debris from the polishing surface. There are several varieties of slurry of varying effectiveness and properties known to the art. At present, for the most common type of CMP tool, the rotary polisher, slurry is applied at a constant flow rate onto the rotating polishing pad using a simple delivery tube, nozzle or spray bar. Fresh slurry flows away from the application point(s) under the influence of gravity and centripetal acceleration and becomes mixed with used slurry or slurry that has passed between the polishing pad and wafer and been involved in polishing.

Old slurry besides being chemically "spent" additionally contains the debris from wafer, conditioner and pad which if the old slurry reenters the gap between the wafer and polishing pad are exposed to the wafer surface and can lead to increases in contamination and defectivity. It is therefore important to remove the debris of polishing, and by extension used slurry, from the polishing pad quickly after it is generated and to the greatest extent possible not reintroduce it under the wafer.

Eventually the rotation of the pad brings the slurry into contact with the leading edge of the wafer, where it forms a bow wave. Some of the fresh slurry at this point is advected into the narrow 10 to 25 micron gap between the wafer and polishing pad and is utilized for polishing. The gap exists because the surface of the pad is rough, the surface of the wafer is relatively smooth and the wafer contacts only the high points of the pad surface. However, most of the fresh slurry remains in the bow wave and is carried to the edge of the pad by the combined rotation of the polishing head and pad. The slurry is then lost over the edge of the pad. Thus, actual slurry utilization, the percentage of new slurry applied that enters the gap between the rough pad surface and the wafer of total slurry applied, is universally quite low in such rotary CMP tools. This is a significant problem because slurry consumption and waste disposal account for a large share of the cost of ownership and operation of a CMP tool.

An additional negative influence on polishing removal rate and uniformity arise because when wafers are polished it is the practice in the art to wash used slurry off between wafers by application of deionized water to the pad, typically to the center of the pad. The time between removing one wafer and replacing it with a second is short and invariably a large quantity of water remains on the pad when polishing of the new wafer begins. This water is not uniformly distributed and as a result it dilutes the newly added slurry in a non-uniform way causing both general decrease in removal rate by the diluted slurry and lack of uniformity in removal rate due to variations in slurry concentration on different parts of the pad. Since this effect lasts several seconds it can exert a significant negative effect on anywhere from 25 percent to 50 percent of the time during which the wafer is polished resulting in a significant and costly reduction in process effectiveness and product quality.

To facilitate the advection or entry of the slurry under the wafer, the practitioners of the prior art have used grooves in the CMP pad. This was effective in making sure that some slurry reached the pad-wafer interface but still allowed most of the slurry to be cast off of the pad without ever having been used. Slurry is expensive and devices, equipment and procedures for providing and removing large amounts of slurry must be included in the CMP process which both complicates and encumbers that process. Presently there is no effective method available for substantially reducing the amount of slurry used or making sure that most of the slurry introduced to the pad during CMP is actually introduced between the pad and the wafer and utilized as intended before being cast off of the pad.

Methods to solve this problem to date have, as stated above, consisted of placing grooves in the surface of the CMP pad to conduct some portion of the slurry under the wafer during CMP polishing. In U.S. Pat. No. 5,216,843 (Breivogel et al filing date 24 Sep. 1992 hereby incorporated by reference) "an apparatus for polishing a thin film" . . . "said apparatus comprising" . . . "a pad covering said table, said pad having an upper surface into which have been formed a plurality of preformed grooves, said preformed grooves facilitating the polishing process by creating a corresponding plurality of point contacts at the pad/substrate interface." and a "means for providing a plurality of micro channel grooves into said upper surface of said pad while polishing said substrate wherein said microchannel grooves aid in facilitating said polishing process by channelling said slurry between said substrate and said pad." Still in U.S. Pat. No. 7,175,510 (Skyopec et al. filing date 19 Apr. 2005 hereby incorporated by reference) a method of polishing wherein "The polishing pad has grooves that channels (sic) slurry between the wafer and polishing pad and rids excess material from the wafer, allowing an efficient polishing of the surface of the wafer." is described. Even as recently as Skyopec et al the preferred method for maximizing the amount of slurry that was introduced between the pad and the wafer was preparation of the grooves and the efforts of practitioners of the art were limited to ensuring that these "micro-channels" were regenerated or maintained in a suitable fashion.

In US 2007 0224920 (hereby incorporated by reference) these grooves are enhanced by holes in the pad made in sizes and shapes appropriate to optimize the amount of slurry conducted under the wafer by the grooves. However this does not solve the basic problem of waste of new slurry due to slurry accumulation in the bow wave.

Moreover, Novellus Systems, Inc. has addressed the slurry utilization problem by means of orbital polishers (U.S. Pat. No. 6,500,055 hereby incorporated by reference) in which the slurry is injected through the polishing pad directly under the wafer (U.S. Pat. No. 5,554,064 hereby incorporated by reference). This guarantees high slurry utilization but requires a complex platen and custom pad to accommodate the slurry distribution system and a specialized polishing tool to take advantage of the injection method. Similarly in US 20070281592 (hereby incorporated by reference) slurries and other conditioning chemicals are introduced and removed through apertures in the diamond conditioning disk for the purpose of facilitating multistep CMP processes but this is not intended to and does not effectively improve the utilization of slurry by directing a larger fraction between the wafer and the CMP pad.

Also in the prior art are U.S. Pat. No. 5,964,413 (hereby incorporated by reference), which teaches an Apparatus for dispensing slurry. This is a device for spraying slurry on to the pad rather than pumping it in specific positions at the pad wafer interface and does not provide the desirable benefits sought by the present invention.

In addition, U.S. Pat. No. 6,929,533, (hereby incorporated by reference) teaches methods for enhancing within-wafer CMP uniformity. This patent describes methods for enhancing the polish rate uniformity of rotary and linear polishers using slurry dispense bars with multiple nozzles to distribute the slurry over the entire wafer track. The slurry dispense bars sit above the pad and do not contact it. This method when compared with the present invention lacks the effect of the creation of a layer of slurry with the same thickness as the wafer-pad gap which allows significant amounts of the new slurry to be advected under the pad the first time.

U.S. Pat. No. 6,283,840 (hereby incorporated by reference) teaches a cleaning and slurry distribution system assembly for use in chemical mechanical polishing apparatus. This apparatus has "an outlet to distribute slurry to the enclosed region to form a reservoir of slurry in the enclosed region, wherein the slurry is distributed to a region not enclosed by the retainer by traveling between the polishing surface and the lower surface of the retainer." However, the application of the slurry to specific land areas where it is needed is not taught and in fact most slurry is lost through grooves between the land areas which generally exceed the land areas in cross sectional area between the wafer and the polishing pad. This apparatus also fails to teach or accomplish control over flow as a function of radius from the center of the polishing pad and there is no teaching or reported effect of separation of the old spent slurry, dilution water or polishing wastes from the newly applied slurry. The main function that the apparatus accomplishes is to keep spray from the slurry or from cleaning agents from depositing on the polisher, where the residue can become a source of defect-causing contamination. This is mentioned several times in the description. The background mentions reducing slurry consumption in passing in the last paragraph, but the patent contains no teaching that the apparatus accomplishes this or indeed how it would be accomplished.

U.S. Pat. No. 5,997,392 (hereby incorporated by reference), teaches Slurry injection technique for chemical-mechanical polishing. The slurry application method involves spraying the slurry onto the pad under pressure from a multiplicity of nozzles, however, this invention suffers from the same drawbacks as U.S. Pat. No. 6,929,533 (hereby incorporated by reference) in that lack of precision in the placement and form of the slurry substantially decreases its effectiveness.

"U.S. Pat. No. 4,910,155 (hereby incorporated by reference) describes the basic CMP process and utilizes a retaining wall around the polishing pad and polishing table to retain a pool of slurry on the pad. It does not describe a particular method for getting the pooled slurry into the pad wafer gap more effectively. U.S. Pat. No. 5,403,228 (hereby incorporated by reference) discloses a technique for mounting multiple polishing pads onto a platen in a CMP process. A seal of material impervious to the chemical action of the polishing slurry is disposed about the perimeter of the interface between the pads and when the pads are assembled the bead squashes and forms a seal and causes the periphery of the upper pad to curve upward creating a bowl-like reservoir for increasing the residence time of slurry on the face of the pad prior to overflowing the pad.

U.S. Pat. No. 3,342,652 (hereby incorporated by reference) teaches a process for chemically polishing a semiconductor substrate and a slurry solution is applied to the surface of the pad in bursts as a stream forming a liquid layer between the cloth and the wafers to be polished. The solution is applied from a dispensing bottle and is applied tangentially to the wafer-plate assembly so as to provide maximum washing of the polishing cloth in order to remove waste etching products. U.S. Pat. No. 4,549,374 (hereby incorporated by reference) shows the use of a specially formulated abrasive slurry for polishing semiconductor wafers comprising montmorillonite clay in deionized water."

U.S. Pat. No. 6,284,092 (hereby incorporated by reference), teaches a CMP slurry atomization slurry dispense system in which " . . . a polishing slurry dispenser device disposed to dispense the slurry toward the pad preferably as a stream or more preferably drops toward the pad surface and a curtain of air to intersect the slurry at or near the polishing pad surface. The wafer is polished using less slurry than a conventional polishing apparatus while still maintaining the polishing rates and polishing uniformity of the prior art polishing apparatus. A preferred dispenser is an elongated housing having a slurry tube and air tube therein each tube having a plurality of spaced apart slurry openings and air openings along its longitudinal axis which tube is preferably positioned radially over at least one-half the diameter of the polishing pad. A polishing slurry is directed from the slurry tube toward the surface of the pad, preferably in the form of drops, and the air from the air tube forms an air curtain, with the air curtain intersecting the slurry drops preferably at or slightly above the pad surface to atomize the slurry."

While this system distributes the slurry uniformly it does not do so in a way that insures that the thickness of the slurry layer at the leading edge of the wafer is at or close to the thickness of the gap.

U.S. Pat. No. 6,398,627 (hereby incorporated by reference) teaches a slurry dispenser having multiple adjustable nozzles. In the teaching of that art, a "slurry dispensing unit for a chemical mechanical polishing apparatus equipped with multiple slurry dispensing nozzles is disclosed. The slurry dispensing unit is constructed by a dispenser body that has a delivery conduit, a return conduit and a U-shape conduit connected in fluid communication therein between for flowing continuously a slurry solution therethrough and a plurality of nozzles integrally connected to and in fluid communication with a fluid passageway in the delivery conduit for dispensing a slurry solution. The multiple slurry dispensing nozzles may either have a fixed opening or adjustable openings by utilizing a flow control valve at each nozzle opening. This patent, as with the previous art referred to, possesses no feature that ensures that the thickness of the slurry layer at the leading edge of the wafer is the same as the wafer pad gap.

U.S. Pat. No. 6,429,131 (hereby incorporated by reference) concerns CMP uniformity and teaches improved CMP uniformity achieved by providing improved control of the slurry distribution. Improved slurry distribution is accomplished by, for example, the use of a slurry dispenser that dispenses slurry from a plurality of dispensing points. Providing a squeeze bar between the slurry dispenser and wafer to redistribute the slurry also improves the slurry distribution. This invention can distribute slurry evenly over the pad but does not provide a uniform layer of slurry the thickness of the gap.

However, although the creation and maintenance of grooves and micro-channels are essential for the operation of CMP polishing generally, they still do not afford an efficient means of introduction of slurry between the pad and the wafer whereby most or even a substantial portion of the slurry introduced onto the pad is actually introduced between the pad and the wafer. Furthermore, although a great many methods have been designed for spreading the slurry evenly on the pad none to date have taught a method for preparing a layer of slurry suitably thick for smooth entry into the pad wafer gap. Most of the slurry continues to accumulate in a bow wave of slurry at the leading edge of the wafer which for the most part moves outward along the leading edge to be dumped off of the edge of the pad and wasted. Moreover, used slurry that has been under the wafer and is contaminated returns as the pad is rotated and mixed with the new slurry at the bow wave decreasing significantly the quality of the slurry used in actual CMP and increasing significantly the waste. And finally none of the methods of the prior art have reduced the negative effects on material removal and uniformity of residual slurry cleaning water added between wafers.

SUMMARY OF THE PRESENT INVENTION

The present invention is a device for injecting slurry between the wafer and the polishing pad in chemical mechanical polishing of semiconductor wafers comprising a solid crescent shaped injector the concave trailing edge of which is fitted to the size and shape of the leading edge of the polishing head with a gap of up to 1 inch, which rests on the pad with a light load, the bottom surface facing the pad, and through which CMP slurry or components thereof are introduced through one or more openings in the top of the injector and travel through a channel or reservoir the length of the device to the bottom where it or they exit multiple openings in the bottom of the injector and are, are spread into a thin film, and are introduced at the gap between the surface of the polishing pad and the wafer along the leading edge of the wafer in quantities small enough that all or most of the slurry is introduced between the wafer and the polishing pad.

The invention is more particularly a device for injecting slurry between the wafer and the pad in chemical mechanical polishing of semiconductor wafers comprising a solid crescent shaped injector, the concave trailing edge of which is fitted to the size and shape of leading edge of the polishing head with a gap of ½ inch, which is resting on the surface of the pad held by a stainless steel pole with a spring and collar on a rod attached to the support mechanism of the CMP polisher by means of which the load on the injector is set at 3 pounds and attached so that it may gimbal freely in terms of bank and pitch angles to the extent permitted by the pad surface but may not rotate in the horizontal plane, the bottom surface facing the pad of which is essentially flat and parallel to and resting on the surface of the pad, wherein the material used in the construction of the device is three polycarbonate sheets, and through which CMP slurry or components thereof are introduced by gravity flow or pressure through one opening in the top of the injector at the radius at which the pad has the greatest contact time with the wafer and travel though a channel to the bottom of the injector where it or they exit 68 openings in the bottom of the injector long a curvilinear line paralleling the trailing edge of the injector at variable spacings corresponding to the pad land areas, are spread into a thin film, and are introduced between the surface of the polishing pad and the wafer along the leading edge of the wafer in quantities small enough that all or most of the slurry is introduced between the wafer and the polishing pad.

The invention is also a method for injecting slurry between the wafer and the pad in chemical mechanical polishing of semiconductor wafers using an apparatus comprising a solid crescent shaped injector the concave trailing edge of which is fitted to the size and shape of leading edge of the polishing head with a gap of up to 1 inch, the bottom surface facing the pad, which rests on the pad with a light load, and through which CMP slurry or components thereof are introduced through one or more openings in the top of the injector and travel through a channel or reservoir the length of the device to the bottom where it or they exit multiple openings in the bottom of the injector, are spread into a thin film, and are introduced between the surface of the polishing pad and the wafer along the leading edge of the wafer in quantities small enough that all or most of the slurry is introduced between the wafer and the polishing pad.

The invention is more particularly a method for injecting slurry between the wafer and the pad in chemical mechanical polishing of semiconductor wafers by using a device comprising a solid crescent shaped injector, the concave trailing edge of which is fitted to the size and shape of leading edge of the polishing head with a gap of ½ inch, which is resting on the surface of the pad held by an stainless steel pole with a spring and collar on a rod attached to the support mechanism of the CMP polisher by means of which the load on the injector is set at 3 pounds and attached so that it may gimbal freely in terms of bank and pitch angles to the extent permitted by the pad surface but may not rotate in the horizontal plane, the bottom surface facing the pad of which is essentially flat and parallel to and resting on the surface of the pad, wherein the material used in the construction of the device is three polycarbonate sheets, and through which CMP slurry or components thereof are introduced by gravity flow and capillary action through one opening in the top of the injector at the radius at which the pad has the maximum contact time with the wafer and travel though a channel to the bottom of the injector where it or they exit 68 openings in the bottom of the injector along a curvilinear line paralleling the trailing edge of the injector spaced to correspond to the land areas of the pad, are spread into a thin film, and are introduced between the surface of the polishing pad and the wafer along the leading edge of the wafer in quantities small enough that all or most of the slurry is introduced between the wafer and the polishing pad.

DETAILED DESCRIPTION OF THE INVENTION

Figure 1:
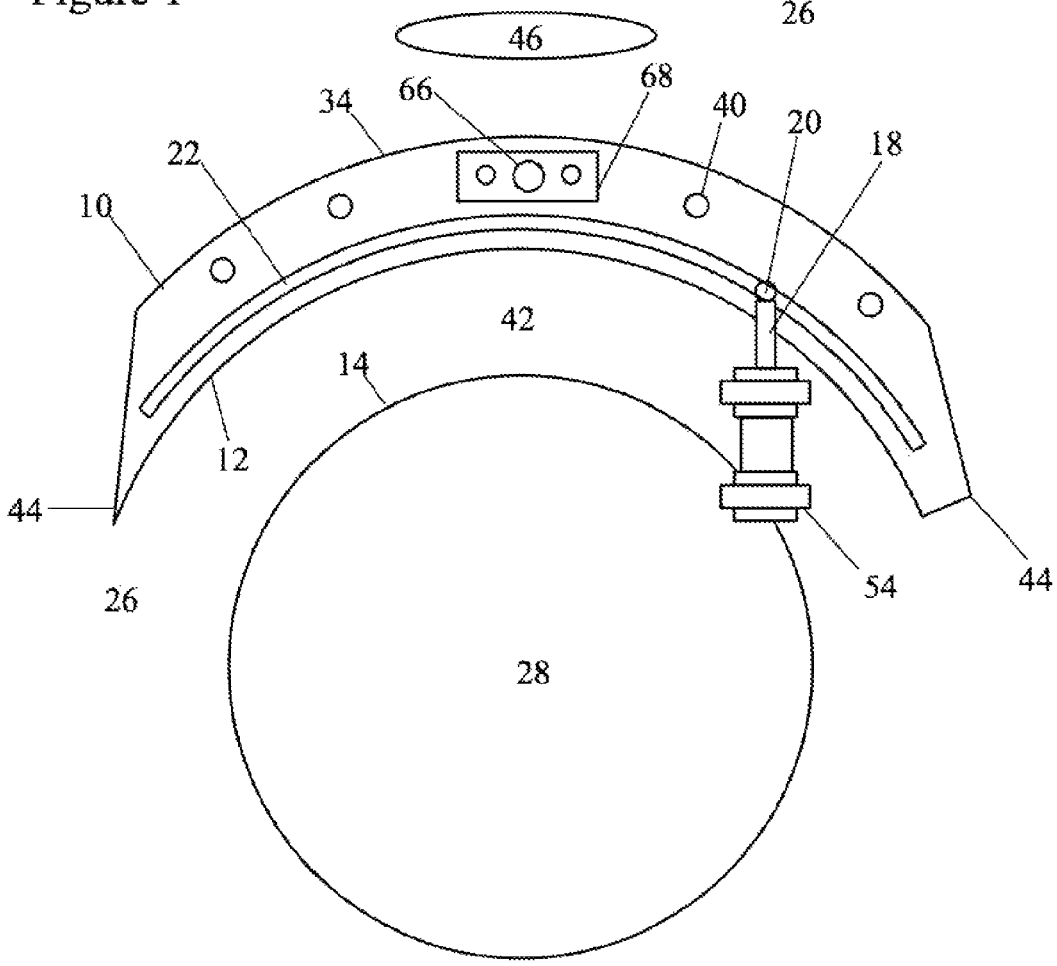
FIG. 1 is a view from above of the injector.

The inventor of the present invention, seeking to make a more efficient use of slurry in CMP processes and a more efficient method of introduction of slurry between the pad and the wafer that insures that more new slurry is advected under the wafer and a higher percentage of old used slurry disposed of as waste and that overcomes the deleterious effects of residual wash water on the CMP pad to subsequent slurry concentration and hence removal rates and uniformity has after considerable research and effort directed to solving this problem discovered a device and a method for the efficient introduction of slurry between the pad and the wafer that will largely eliminate the waste of slurry, mixing of old and new slurry and residual wash water dilution effects characteristic of the CMP polishing methods of the prior art and allow the operator of rotary CMP polishing equipment considerable control over the introduction of slurry between the wafer and the pad. More particularly, the inventor has invented an apparatus for use in chemical mechanical polishing of semiconductor wafers that applies slurry between the wafer and the pad near the leading edge of the wafer in a thin film that is comparable in thickness to the gap between the pad and the wafer, thus substantially reducing the volume of the wafer leading edge bow wave and insuring that a high fraction of fresh slurry is used for polishing. The apparatus also creates a second bow wave at the leading edge of the injector physically separated from the wafer leading edge bow wave that contains only spent slurry and residual wash water. Most slurry disposal or waste is from this second bow wave, which also catches and disposes of most of the rinse water and incompletely mixed rinse water and slurry present at the onset of polishing that otherwise would enter the pad-wafer gap and exert a negative effect on removal rates and uniformity. This apparatus, incorporating these two elements, allows a CMP tool to use a significantly lower overall flow rate by reducing the mixing of fresh and used slurry and the uncontrolled dilution of slurry by wash water prior to use at the wafer, by insuring that the utilization of fresh slurry is close to 100% and by ejection of only used slurry and wash water from the second bow wave.

This apparatus more particularly comprises a solid crescent shaped injector, the concave trailing edge of which conforms to the size and shape of the leading edge of the wafer or polishing head set with a gap of up to 1 inch, which rests on the polishing pad with a light load, the bottom surface facing the polishing pad of which is essentially flat and parallel to the surface of the said polishing pad and in contact with it, and through which CMP slurry, or components thereof, are introduced through one or more tubes attached on one end to the slurry or slurry component source which may be the normal slurry supply system and on the other end to inlets in the top of the injector, and travels through an internal distribution channel or reservoir extending the length of the solid crescent shaped injector and over that part of the polishing pad that is touched by the wafer, through the bottom of the solid crescent shaped injector where the slurry exits multiple openings in the bottom of the solid crescent shaped injector, is spread over the polishing pad surface in a thin film, and is introduced between the surface of the polishing pad and the wafer along the leading edge of the wafer in quantities small enough to insure that all or most of the slurry is introduced between the wafer and the polishing pad.

In one embodiment, customized for commonly employed concentrically grooved polishing pads, the injector possesses one small opening per raised area between the grooves or, in other words, the "land" areas of the polishing pad. When aligned with the said land areas, the apparatus injects slurry directly onto each land area that passes under the wafer, thus providing fresh slurry exactly where it is needed for polishing. After exiting the small opening at the bottom of the solid crescent shaped injector, the fresh slurry is spread into a thin film by the trailing portion of the bottom surface of the solid crescent shaped injector which sits with a light load upon the polishing pad surface. The thickness of the film is comparable to the thickness of the gap between the polishing pad and the wafer.

Additionally, the inventor has discovered a method in CMP for an applying slurry between the wafer and the polishing pad near the leading edge of the wafer in a thin film that is comparable to the polishing pad wafer gap, thus reducing or eliminating the wafer leading edge bow wave and insuring that a high fraction of fresh slurry is used for polishing the wafer, and that creates a second bow wave at the leading edge of the solid crescent shaped injector, which second bow wave is physically separated from the wafer leading edge by the solid crescent shaped injector, and which second bow wave contains only spent slurry or residual water or both, by utilization of an apparatus for injecting slurry between the wafer and the polishing pad comprising a solid crescent shaped injector the concave trailing edge of which conforms to the size and shape of leading edge of the wafer with a gap of up to 1 inch, which rests on the surface of the polishing pad with a light load, the bottom surface facing the polishing pad of which is essentially flat and parallel to the surface of the said polishing pad, and through which CMP slurry, or components there of such as solvents or particulates, are introduced through one or more tubes attached on one end to the slurry or slurry component source which may be the normal slurry supply system and on the other end to inlets in the top of the solid crescent shaped injector, and travels through an internal distribution channel extending the length of the solid crescent shaped injector over that part of the polishing pad that is touched by the wafer, through the bottom of the solid crescent shaped injector where the slurry may exit through multiple openings, be spread by the trailing edge of the bottom of the solid crescent shaped injector over the polishing pad in a thin film, and be introduced between the surface of the polishing pad and the wafer along the leading edge of the wafer in quantities small enough that all or most of the slurry is introduced between the wafer and the polishing pad.

In one embodiment, customized for commonly employed concentrically grooved polishing pads, the solid crescent shaped injector contains one small opening per "land" area. When aligned with the land areas of the polishing pad, the apparatus injects slurry in a thin film directly onto each land area that passes under the wafer, thus providing fresh slurry exactly where it is needed for polishing. After exiting the small opening at the bottom of the injector, the fresh slurry is spread into a thin film by the trailing edge of the bottom surface of the solid crescent shaped injector which sits with a light load upon the pad surface. The thickness of the film thus created is comparable to the thickness of the gap between the polishing pad and the wafer.

The apparatus of the present invention has been developed in response to the present state of the art, and in particular, in response to the problems and needs in the art that have not yet been fully solved by currently available CMP slurry supply systems for CMP tools. Thus, it is an overall objective of the present invention to provide CMP slurry injectors and related methods that remedy the shortcomings of the prior art.

The purpose of this device and method are to allow more effective injection of slurry into the space between the polishing pad and the wafer and to prevent new slurry by being contaminated by old slurry that has remained on the pad after use under the wafer and by residual water used to clean the polishing pad between wafers. Much of the new slurry added to the polishing pad by conventional means forms a bow wave in front of the leading edge of the wafer or the wafer retainer. In this bow wave new and used slurry as well as residual water mix and much slurry, including new slurry is diluted or allowed to flow off of the disk and is wasted. The slurry reaching the disk contains a substantial portion of old slurry and is often at levels of dilution that are either inconsistent and produce variant removal rates or is generally low to support effective removal.

CMP slurry should be new (pre-diluted) slurry so that it is more able to wear away and planarize the metal surface of wafers for such semiconductor wafers as silicon wafers or silicon compound wafers that have been plated with copper or tungsten or other materials and thereafter to planarize the semiconductor surface itself. When old slurry or water are allowed to mix with new slurry in large and uncontrolled amounts and much of this mixture is allowed to be disposed of from the polishing pad without ever having been used under the wafer, there is substantial waste of slurry and the slurry that does eventually find its way under the wafer is not entirely effective.

Manufacturers and users of CMP pads need to minimize slurry waste and maximize slurry efficiency and consistency in quality of the slurry applied to obtain the most cost effective and high quality polishing of wafers.

The problem of waste and the resultant inconsistent and often poor quality of the slurry that ends up under the wafer has been known in the art for some time.

The present invention overcomes the problems of the prior art by maintaining the physical separation of used slurry and residual water from newly added slurry on the polishing pad surface and by insuring that as much as possible of the new slurry ends up in the gap between the wafer and the polishing pad and not in a bow wave before the leading edge of the wafer where much if not most of it would be sloughed off of the edge of the polishing pad by centripetal forces generated by the rotation of the pad without ever having been used.

Through the use of the slurry injector of the present invention, consistent, effective and reduced volume usage of slurry use can be achieved easily with improved polished wafer quality.

All dimensions for parts in the present invention follow are based on a pad size of about 20" to 30" in diameter and a wafer size of between [8"] and [12"] in diameter and may be altered as needed in proportion to changes in the size of the polishing pad and wafer used. The specific dimensions given herein are in no way limiting but are by way of example to demonstrate an effective embodiment of the invention.

The present invention comprises a device and a method for the efficient introduction of slurry between the polishing pad and the wafer that will largely eliminate the waste of slurry characteristic of the CMP polishing methods of the prior art, allow the use of a purer unused and undiluted slurry at the polishing pad surface at all times and additionally allow the operator of CMP polishing equipment considerable control over the introduction of slurry between the wafer and the polishing pad. More particularly, beginning with FIG. 1, the present invention comprises a device for injecting slurry between the wafer and the polishing pad in the chemical mechanical polishing of semiconductor wafers comprising a solid crescent shaped injector (10) the concave trailing edge (12) of which conforms to the size and shape of leading edge (14) of the wafer (28) with a gap (42) of up to 1 inches, which rests on the polishing pad (26) with a light load, the bottom surface (16) of which is essentially flat and parallel to the surface (36) of the polishing pad (26), and through which CMP slurry or components thereof are introduced through one or more tubes (18) or other suitable means of delivery attached to inlets (20) in the top (76) of the solid crescent shaped injector (10) and flow through a channel or reservoir (22) the length of the solid crescent shaped injector (10) to the bottom (78) of said channel or reservoir (22) where it or they exit the solid crescent shaped injector (10) through multiple openings (24) in the bottom (16) thereof and are pressed between the said bottom (16) of the solid crescent shaped injector (10) and the polishing pad (26), spread into a thin film and introduced at the gap between the surface (36) of the polishing pad (26) and the wafer (28) along the leading edge (14) of the wafer (28), preferably on the "land" (30) areas between the grooves (32) in the pad, in quantities small enough and in a film thin enough so that all or most of the slurry is introduced between the wafer (28) and the polishing pad (26) and by which used slurry is more effectively kept separate from newly injected slurry by its concentration in a second bow wave (46) at the leading edge (34) of the solid crescent shaped injector (10).

Moreover the present invention comprises a method for injecting slurry for chemical mechanical polishing of semiconductor wafers between the surface of the wafer (28) and the surface (36) of the polishing pad (26) by utilization of a device for injecting slurry between the wafer (28) and the polishing pad (26) in CMP polishing comprising a solid crescent shaped injector (10) the concave trailing edge (12) of which is fitted to the size and shape of leading edge (14) of the wafer (28) with a gap (42) of up to 1 inch, preferably between 1/32 inch and 1 inch, the bottom surface (16) facing the polishing pad (26) of which is essentially flat and parallel to the surface (36) of the polishing pad (26), which rests on the polishing pad (26) with a light load, and through which CMP slurry or components thereof are introduced through one or more inlets (20) in the top (76) of the solid crescent shaped injector (10) and travel to the bottom (16) of the solid crescent shaped injector (10) where the slurry or slurry components exit openings (24) in the said bottom (16) of the solid crescent shaped injector (10), are spread into a thin film, and are introduced between the surface (36) of the polishing pad (26) and the wafer (28) along the leading edge (14) of the wafer (28), preferably on the "land" (30) areas between the grooves (32) in the polishing pad (26), in quantities and dimensions small enough that all or most of the slurry is introduced between the wafer (28) and the polishing pad (26).

As the polishing tool, any suitable rotary polishing tool may be used. In particular existing rotary polishing tools may be retrofitted with the apparatus of the present invention. Any polishing pad (26) suitable for use in CMP may be used. Moreover, any diamond conditioner disk suitable for use in CMP may be used.

For the slurry, any applicable CMP slurry may be used and for example, silica based and alumina based slurries may either or both be used.

The solid crescent shaped injector (10) may be constructed of any hard material, such as metal, plastic, ceramic or glass, suitable for CMP processes as a solid block shaped by any suitable means to include the inlets (20) trailing crescent edge (12) and leading crescent edge (34), the openings (24), channels and reservoir (22), where applicable, or in parts to be joined or by layers. Construction by layers (56) of polycarbonate sheeting cut to the appropriate shapes to incorporate the internal channel or reservoir (22) and the leading crescent edge (34) and trailing crescent edge (12) is preferred. This is true both because polycarbonate sheets are cost effective, light and durable and because polycarbonate's transparency allows the operator to see the condition of slurry in the internal channel or reservoir (22) where one is used. Where layers (56) are used, any suitable method including but not limited to adhesives and bolts (40) may be used to hold the layers (56) together and bolts (40) are preferred.

The concave trailing edge (12) of the solid crescent shaped injector (10) is fitted to the size and shape of leading edge (14) of the wafer (28). The trailing edge (12) of the solid crescent shaped injector (10) may be matching in shape and dimension to the leading edge (14) of the wafer (28) or there may be a variation in curve to avoid mechanical interference. A matching edge is preferred, particularly where the gap (42) is small. The length of the crescent shaped injector (10) (difference between the apices of the horns (44)) should be sufficient to substantially cover the leading edge (14) of the wafer (28) or between 4 and 18 inches, depending on the diameter of wafer (28) being polished. Any means of shaping may be used, however, where polycarbonate sheets are used shaping accomplished by cutting is preferred.

The distance between the wafer (28) and the trailing edge (12) of the solid crescent shaped injector (10) at the widest point should be between 0 and 1 inches. The leading edge (34) of the solid crescent shaped injector (10) may be crescent or rectangular in shape or may be any other suitable shape that interferes minimally with CMP process, at the same time allows for sufficient capacity in the slurry channel or reservoir (22) where one is used, and creates a suitable second bow wave (46) to remove the used slurry from the polishing pad (26) before it can mix with the new unused slurry.

The load of the solid crescent shaped injector (10) resting on the polishing pad (26) is between 1 and 10 lb or more and generally is sufficient to apply enough pressure so that the mean gap (82) between the bottom surface (16) of the solid crescent shaped injector (10) and the polishing pad (26) is comparable within a small multiple to the mean gap between the wafer (28) and the pad (26). The latter is frequently measured to be between 10 and 25 microns, but larger or smaller gaps are also possible.

The bottom surface (16) of the solid crescent shaped injector (10) facing the polishing pad (26) is flat and smooth, though depending upon need it may be textured, grooved or shaped. The bottom surface (16) is essentially parallel to the surface (36) of the polishing pad (26), though in case of need, a variation in pitch or bank could be made. The gap (82) can be adjusted by planarization of the bottom surface (16) of the solid crescent shaped injector (10). The CMP slurry or components thereof are introduced to the solid crescent shaped injector (10) through one or more openings (20) in the top (76) thereof The number and size of openings (24) in the bottom surface (16) are not limited but a diameter of 0.01 to 0.125 inches is preferred and between 40 and 160 openings (24) are preferred. It is preferred that the said openings (24) correspond in position and number to the "land" (30) areas on the polishing pad (36), and one opening (24) placed above each "land" (30) area is more preferred. The linear arrangement of the openings (24) is not limited but it is preferred that they be arranged along a straight or curved line. The openings (24) should be placed at whatever location and separation distance from each other would be suitable for them to be directly above a land (30) on the polishing pad (36).

The means of introducing slurry to the solid crescent shaped injector (10) is not particularly limited but a Tygon tube (18) connected to the slurry supply system of the CMP tool is preferred. The tube (18) may be attached to the solid crescent shaped injector (10) by any suitable means but a quick connect coupling (54) is preferred. For the positioning of the inlet openings (20) in the top of the solid crescent shaped injector (10), any positioning or pattern may be used but a position coincident with the radius at which a point on the polishing pad (26) has the longest transit time under the wafer (28) is preferred. The size of the channel or reservoir (22) and whether it is a narrow channel or a reservoir (22) should be considered when positioning of the inlet (20).

The solid crescent shaped injector (10) may be made by any suitable means but a method whereby the solid crescent shaped injector (10) is constructed of three layers (56) of shaped or cut hard material, and preferredly three polycarbonate sheets, joined together by any suitable means is preferred. The layers (56) may be of the same or different thickness and any thickness that is not so thin as to result in a solid crescent shaped injector (10) too weak to endure the rigours of CMP polishing or so thick as to be cumbersome and inapplicable may be used and a uniform layer (56) thickness of 0.17 inch for each layer (56) is preferred.

In the event the said layers (56) are used, they may be of uniform thickness or they may be bevelled, particularly the middle layer, if a channel or reservoir (22) is used, to produce a channel or reservoir (22) of varying thickness in the event this is desirable. Layers (56) of uniform thickness are preferred. The lines or channels (22) for introducing slurry to the bottom surface of the injector may be a direct channel through the injector, may be branched or may comprise a channel or reservoir (22) created, in particular, by removing a more extensive section of the middle layer (86) in the three layer case. In the event that such a channel or reservoir (22) is utilized, the shape of the channel or reservoir (22) may be the same essential shape as the solid crescent shaped injector (10) or it may be an oval or ovoid or a simple channel or any other suitable uniform shape. The channel or reservoir (22) should have bleed valves at either end to remove air when slurry is introduced.

A flow meter or other suitable sensors may be added to monitor slurry flow preferably before the point of entry into the solid crescent shape (10).

Where a channel or reservoir (22) is used a reservoir having an essentially oval shape centered on the center of the injector or a channel or reservoir (22) whose lateral boundaries are a fixed distance from the outer lateral boundaries (12) (34) of the solid crescent shaped injector are preferred, The upper surfaces (60) and lower surfaces (62) of the channel or reservoir (22) may be parallel and flat, may be at a slight planar angle with respect to each other or may be slightly rounded. Parallel, smooth planar upper (60) and lower surfaces (62) of the channel or reservoir (22) are preferred.

The openings (24) by which the slurry exits the solid crescent shaped injector (10) in the bottom surface (16) of the solid crescent shaped injector (10) may be any shape and size but round or oval shapes are preferred and round is more preferred. The diameter of the exit openings (24) may be any diameter but for a total of 68 openings (24) on the solid crescent shaped injector (10) a diameter of about 0.0625 inches is preferred. The openings (24) may be made perpendicular to the bottom surface (16) or at an angle. The openings (24) may be made by any suitable means but drilling is preferred. In the event that multiple openings (24) are used any positioning and pattern may be used but curvilinear spacing of openings (24) corresponding the radii of the land (30) areas and following the curve of the trailing edge (12) of the solid crescent shaped injector (10) and about ¼ inch leading it is preferred.

The flow rate of the slurry through the solid crescent shaped injector (10) is influenced by the location of the openings (24) with respect to the radial distance of the openings (24) from the center of the polishing pad (26). Consequently the size, shape, angle of incidence, and density pattern may be adjusted to optimize flow conditions. The slurry may be introduced into the channel or the reservoir (22) in the solid crescent shaped injector (10) by gravity flow or by pumping. If it is introduced by pumping the rate should be approximately 50 cc/min or above for 68 openings (24) or about 0.73 cc/min or above per opening (24).

The solid crescent shaped injector (10) position on the polishing pad (26) can be maintained by means of any suitable device but a beam (64) with a rod (66) to which the solid crescent shaped injector (10) is attached is preferred. The beam (64) or rod (66) should be strong enough to withstand the rigors of the CMP process and should be between 0.25 inch and 0.75 inch in diameter or thickness as the case may be. Stainless steel is preferred as their component material. The solid crescent shaped injector (10) should be detachable from the rod (66) so that it may be cleaned or replaced when worn. This also allows switching of solid crescent shaped injectors (10) with different hole patterns corresponding to different polishing pad (36) grooving geometries.

The point of contact between the solid crescent shaped injector (10) and the rod (66) or other means of support in the present invention is gimballed (68) so that the pitch or bank of the solid crescent shaped injector (10) may be adjusted or move slightly. The upper end of the rod (66) may be secured to the support mechanism of the CMP tool by any suitable means such as a set screw (74). A load may be applied using a combination spring (70) and collar (72) with the load being fixed prior to tightening the set screw (74) for the rod (66), or dead weights (50) may arranged on the top surface (76) of the solid crescent shaped injector (10) to apply the load prior to tightening the set screw (74). The collar (72) is fixed to the rod (66) by means of a separate set screw (73). A suitable load sensor may be attached to determine the load during operation.

In the event that the slurry is pumped into the solid crescent shaped injector (10), any suitable flow rate may be used, for example, slurry may be pumped at the rate of 30-300 cc per minute.

The gimbal (68) device at the point of attachment between the solid crescent shaped injector (10) and the rod (66) may be any suitable gimbal (68) device that allows adjustment of the pitch and bank angles without permitting rotation around the axis of the rod (66). This may be a fixed adjustment or the solid crescent shaped injector (10) may be allowed to adjust naturally so that it lies flat against the polishing pad (26) surface (36). This gimbal (68) feature allows the operator to lay down a very thin film of slurry and in so doing also effectively segregate the used slurry in a bow wave (46) at the leading edge of the solid crescent shaped injector (10) without losing the flat orientation of the bottom (16) of the solid crescent shaped injector (10) as it sits on or above the polishing pad (26).

EXAMPLES

A Rohm and Haas IC-10-A2 CMP pad was attached to an Araca Incorporated APD-500 200 mm CMP polishing tool and a Mitsubishi Materials Corporation TRD conditioning disk was attached as well. A stainless steel shaft approximately 6.5 inches in length and 0.3125 inch in diameter was slipped into a hole in an adjustable beam clamped to the support mechanism of the CMP tool. A spring was placed between the collar and the support mechanism along the rod, the spring was compressed, and the collar was attached with a set screw to the rod. This had the effect of transferring the force from the spring to the surface of the pad via the injector. A separate set screw for the rod in the adjustable beam was then used to attach the rod to the support mechanism to fix the load and to prevent the rod from turning about its own axis.

The injector was fabricated with three sheets of clear polycarbonate (GE Plastics XL10, 0.17 inch thickness) cut together using a band saw to produce three identical crescent shapes [FIG. 1] approximately 10 inches from horn to horn and with a trailing edge radius corresponding to a polishing head of diameter 11.125 inches and a width of 1 inch. Four bolt holes were drilled at intervals of about 2 inches on the sides near the convex (leading) edge of the shapes and with a separation of about 4 inches in the middle and in one of these sheets (bottom) the holes were recessed at ⅜ inch diameter to a depth of about 0.1 inch to accept press fit threaded aluminum nuts. A hole ½ inch in diameter was drilled through the other two sheets (top and middle) and half way through the bottom sheet to accept the gimbal mechanism. In the middle sheet a long distribution channel was cut all the way through the length of the sheet to within ¼ inch of the horns at a distance of about ¼ inch equidistant and in front of the concave trailing edge if the middle sheet. The channel was ⅛ inch in width. Using a separate template constructed with the aid of a polishing pad, 68 holes were drilled (1/16 inch diameter) along the course of the channel through the bottom layer at the variable spacing required to align the holes with land areas on the pad. The holes were perpendicular to the surface of the sheets. Finally an inlet hole of ⅜ inch diameter was drilled in the top sheet and fitted with an aluminum inlet tube, a 4 inch section of Tygon tubing, and a quick connector suitable for attachment to the Tygon tubing used with the polisher.

The sheets were affixed together so that the edges were even and bolted placing the nuts in recesses in the bottom sheet to make the injector. Prior to assembly, gaskets cut from water-resistant fiberglass reinforced double sided adhesive cloth (3M) were attached to the top and bottom of the middle sheet. A gimbal mechanism allowing free adjustment of bank and pitch but not rotation about the axis of the rod was placed in the half inch hole on the top of the injector, secured with a metal pin, and attached to the rod. The slurry delivery tube was attached to the inlet tube of the top sheet and the trailing edge of the injector was adjusted so that it was approximately 0.5 inch from the leading edge of the polishing head, and so that the injection holes lined up with the "land" areas on the pad.

Practice Examples 1-5

After successful preliminary tests of the integrity and stability of the injector using water flow rates between 50 and 200 cc/min and platen rotation rates between 10 and 80 RPM, a polishing test was run as follows. A new Rohm and Haas IC-10-A2 pad was conditioned for 45 minutes with a new 3M A165 100 grit conditioning disk on an Araca Incorporated APD-500 polisher using the "best known method" conditioning sweep, which was designed to optimize the flatness of the pad surface over the lifetime of the pad. Two hundred millimeter diameter wafers with a layer of silicon dioxide deposited from a tetraethoxysilane source (known as TEOS wafers) were then polished at 4 PSI for 1 minute with in situ conditioning (conditioning while polishing) using Fujimi PL4072 fumed silica slurry with a platen rotation rate of 55 RPM and a carrier rotation rate of 53 RPM. After each wafer was polished, used slurry was rinsed from the pad by applying 2-3 liters of deionized water from a beaker. Prior to running wafers to be used for measuring removal rates ("rate wafers"), a used ("dummy") TEOS wafer was processed for several minutes and then a series of 11 TEOS dummies were polished for one minute each until the mean coefficient of friction (COF) stabilized. Two TEOS rate wafers were then polished at each of the injector flow rates 150, 120, 90, and 60 and 30 cc/min in that order. A flow rate of 150 cc/min is the standard slurry flow rate used on the tool for a platen rotation rate of 55 RPM. After each change in flow rate, a TEOS dummy was run for 1 minute to stabilize the system prior to running rate wafers. Mean removal rates measured using a reflectometer from two diameter scans of each of the two rate wafers processed at each flow rate were 2430, 2408, 2405, 2276 and 2026 Angstroms/minute at 150, 130, 90, 60 and 30 cc/min, respectively. Shear force standard deviations were 3.0, 3.4, 4.0, 4.2 and 6.0 lb at 150, 120 90, 60 and 30 cc/min, respectively The shear force standard deviation measures how smoothly the tool is running and is a small fraction of the total applied polishing force at 4 PSI of 201 lb.

Comparative Experiments 1-5

The injector was removed, seven TEOS dummies were polished for one minute each until the COF stabilized, and then two rate wafers were polished while slurry was pumped onto the center of the pad (center application) at flow rates of 150, 120, 90, 60 and 30 cc/min. A dummy wafer was polished prior to the two rate wafers each time that the flow rate was reduced. Rinse water [about 2-3 liters] was applied to the pad to remove the old slurry after polishing each wafer. Center slurry application with a water rinse between wafers is the standard procedure for the polishing tool. Mean removal rates from a total of 4 diameter scans from the two rate wafers at each flow rate were 2378, 2329, 2321, 2125 and 1827 Angstroms/minute at 150, 120, 90, 60 and 30 cc/min respectively. Thus, at every flow rate, the removal rate achieved using the injector exceeded the rate achieved using the standard center application-rinse procedure by 4-11%. Relative to the standard procedure run at 150 cc/min, the same removal rate could be achieved with the injector using about half as much slurry. Shear force standard deviations in the center application experiment were 4.7, 5.2, 4.5, 6.2 and 7.4 lb at 150, 120 90, 60 and 30 cc/min, respectively. In every case, the shear force standard deviation using the injector is less than it is with center application, indicating that the injector facilitates both a higher removal rate and a smoother polishing process.

Practice Examples 6-10

Except that between wafer polishing runs, rinse water was not applied to the pad to remove excess slurry, the same procedures were applied as in Example 1 at each of the injector flow rates 150, 120, 90, and 60 and 30 cc/min in that order to obtain Examples 11-20. Removal rates were 2571, 2536, 2501, 2464 and 2438 Angstroms/minute at 150, 130, 90, 60 and 30 cc/min, respectively. Shear force standard deviations were 4.0, 3,9, 3.4, 3.6 and 3.5 lb at 150, 130, 90, 60 and 30 cc/min respectively.

Comparative Experiments 6-10

Except that between wafer polishing runs, rinse water was not applied to the pad, the same procedures were applied as in Comparative Experiment 1 at each of the injector flow rates 150, 120, 90, 60 and 30 cc/min in that order to obtain Comparative Experiments 6-10. Removal rates were 2572, 2522, 2531, 2488 and 2422 Angstroms/minute at 150, 130, 90, 60 and 30 cc/min, respectively. Shear force standard deviations were 3.4, 3.3, 3.8, 3.2 and 3.0 lb at 150, 130, 90, 60 and 30 cc/min respectively. Thus, without the water rinse, identical removal rates and shear force standard deviations were measured with and without the injector at each flow rate. This shows that when a water rinse is used, the injector provides a higher removal rate and smoother polishing process than center application by reducing the mixing of fresh slurry with the rinse water and used slurry on the pad at the onset of polishing.

DETAILED DESCRIPTIONS OF THE DRAWINGS

FIG. 1 is a top view of the solid crescent slurry injector and the wafer.

10 is the solid crescent shaped injector

12 is the concave trailing edge of the solid crescent shaped injector 10

14 is the leading edge of the wafer

18 is the slurry supply tube

20 is the slurry inlet in the top of the solid crescent slurry injector 10

22 is the channel or reservoir for conducting slurry in the solid crescent slurry injector 10. It is visible because in this embodiment the body of the solid crescent slurry injector 10 is made of transparent polycarbonate sheets.

26 is the polishing pad

28 is the wafer

34 is the leading edge of the solid crescent shaped injector

40 are the bolts holding the solid crescent slurry injector 10 together.

42 is the gap between leading edge 14 of the wafer 26 and trailing edge 12 of the solid crescent slurry injector 10.

44 are the horns at the end of the solid crescent slurry injector 10.

46 is the second bow wave in front of leading edge 34 of the solid crescent slurry injector 10 (Note that the present invention effectively eliminates the first bow wave which would normally form in the gap 42.

54 is the quick connect that connects the tube 18 to the slurry source (not shown).

66 is the rod that holds the solid crescent slurry injector 10

68 is the gimbal attached to the solid crescent slurry injector 10 in which the rod 66 is seated.

Figure 2:
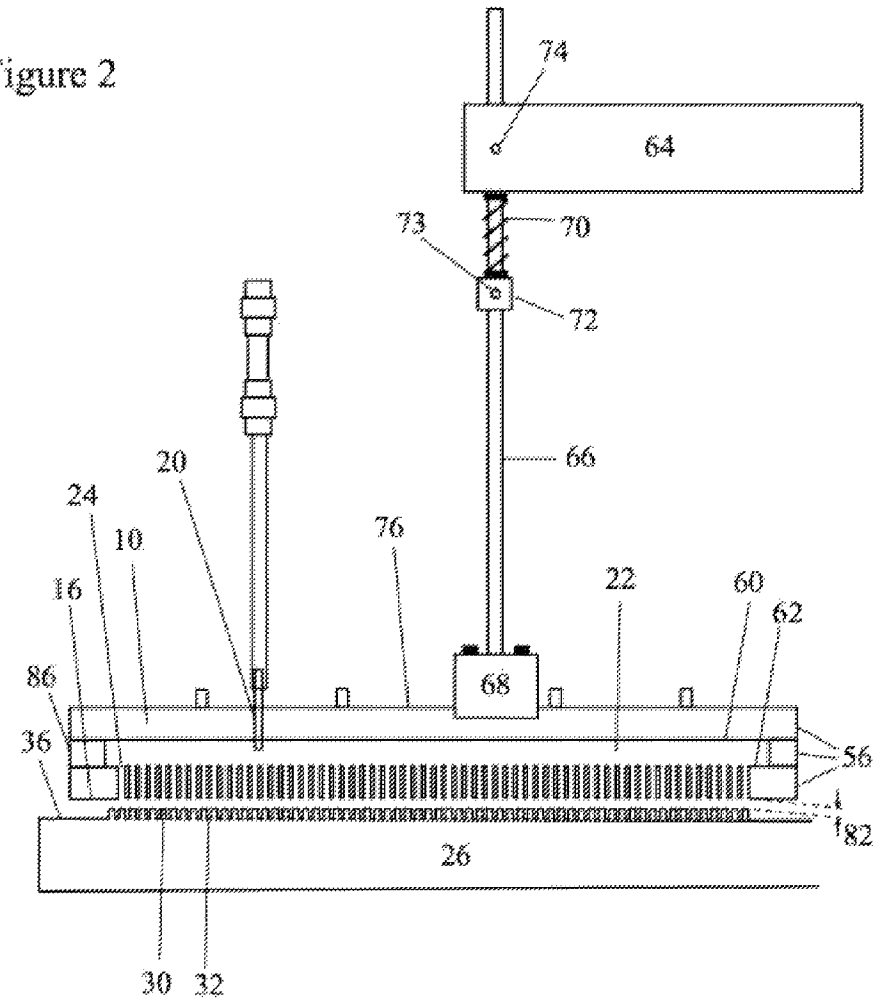
FIG. 2 is a cross section side view of the injector over the pad.

FIG. 2 is a side view of the basic unweighted solid crescent slurry injector 10. Numbering not indicated here is the same as in FIG. 1

16 is the bottom surface of the solid crescent slurry injector 10

24 are the openings in the bottom surface 16 of the solid crescent slurry injector 10

30 are the land areas on the upper surface of the polishing pad

32 are the grooves between the land areas 30

36 is the upper surface of the polishing pad 26

20 is an opening for slurry to be admitted to the solid crescent slurry injector 10

56 are the layers from which the solid crescent slurry injector 10 in this embodiment is constructed.

60 is the upper surface of the channel or reservoir 22

62 is the lower surface of the channel or reservoir 22

64 is the beam from the polishing tool (not shown) that supports the injector.

70 is a spring to set load on the entire solid crescent slurry injector 10.

72 is a collar to hold the spring 70 on the rod 66.

73 is a set screw to the collar 72

74 is a set screw to hold the rod 66 to the beam 64

76 is the top surface of the solid crescent slurry injector 10

Figure 3:
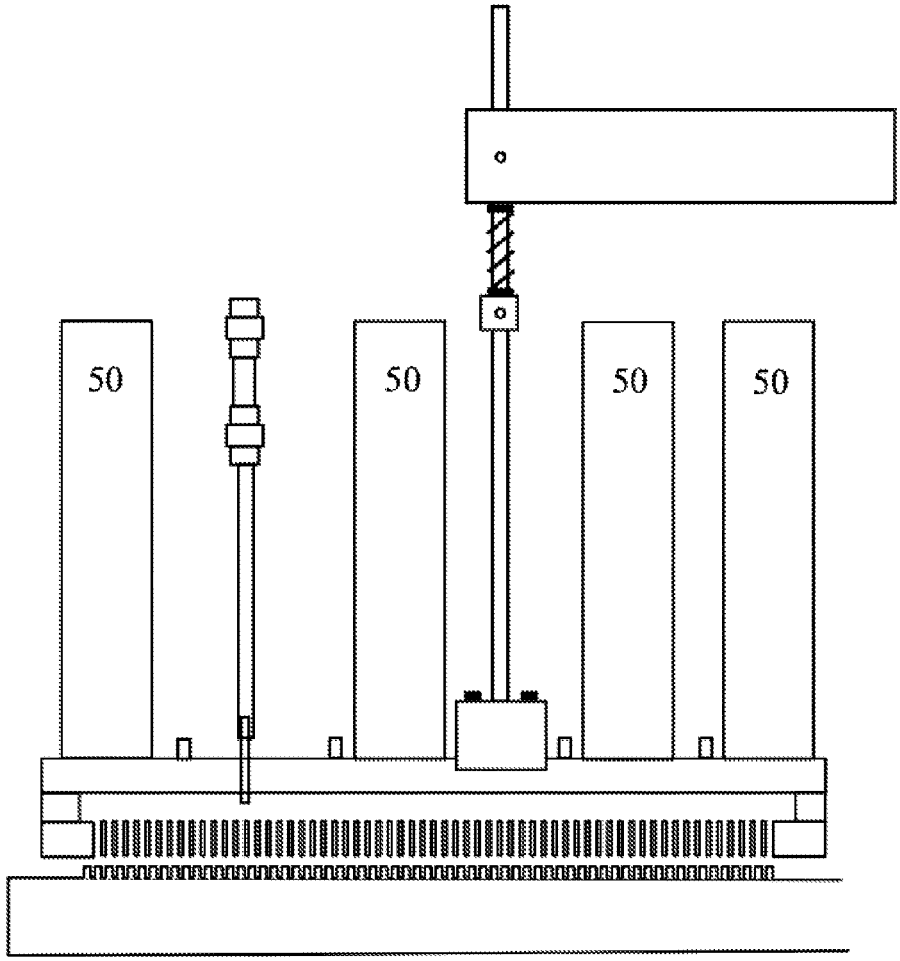
FIG. 3 is a cross section side view of the injector over the pad with weights added.

FIG. 3 is a side view of the solid crescent slurry injector 10 with weights added to balance the bottom surface 16. Numbering not indicated here is the same as in FIGS. 1 and 2

50 are the weights to adjust the planarity of the bottom surface 16

The invention claimed is:

1. An injector device for injecting slurry between a semiconductor wafer and a polishing pad of a chemical mechanical polishing tool, the injector device comprising:

an injector top surface comprising one or more than one injector top surface opening;

an injector bottom surface comprising multiple injector bottom surface openings, wherein the injector bottom surface faces a polishing pad top surface, and wherein the injector bottom surface rests on the polishing pad top surface; and an injector concave trailing edge, wherein the injector concave trailing edge is fitted to the size and shape of a leading edge of a polishing head of the chemical mechanical polishing tool;

wherein a CMP slurry introduced through the one or more than one injector top surface openings travels through a channel in the injector device and exits the injector device through the multiple injector bottom surface openings onto the polishing pad top surface; and wherein the injector device is attached to a rod with a spring and a collar to assure contact with the polishing pad top surface, and wherein the injector device is gimbaled so that it moves freely to the extent permitted by the polishing pad top surface.

2. The device of claim 1, wherein the material used for the construction of the injector device comprises three layers of hard plastic sheet.

3. The device of claim 1, wherein the flow rate of the slurry from the one or more than one injector top surface opening to the multiple injector bottom surface openings is controlled by gravity feed.

4. The device of claim 1, wherein the flow rate of the slurry from the one or more than one injector top surface opening to the multiple injector bottom surface openings is controlled by pumping at a controlled rate.

5. The device of claim 1, wherein the number of injector top surface openings is equal to one.

6. The device of claim 5, wherein the one injector top surface opening is located at a radius from a center of the polishing pad at which the polishing pad top surface has the greatest contact time with the wafer.

7. The device of claim 1, wherein the multiple injector bottom surface openings are placed in a curvilinear pattern, wherein the pattern of the multiple injector bottom surface openings is parallel to the injector trailing edge, and wherein the multiple injector bottom surface openings are spaced to align with one or more than one land areas on the polishing pad.

8. The injector device of claim 7, wherein the number of multiple injector bottom surface openings is 68.

9. A device for injecting slurry between a semiconductor wafer and a polishing pad of a chemical mechanical polishing tool, the device comprising:

a solid crescent shaped injector, wherein the solid crescent shaped injector comprises:

a concave trailing edge, wherein the concave trailing edge is fitted to the size and shape of a leading edge of a polishing head of the chemical mechanical polishing tool, with a gap of ½ inch between the concave trailing edge and the leading edge of the polishing head; and an injector bottom surface, wherein the injector bottom surface faces a top surface of the polishing pad, and wherein the injector bottom surface is essentially flat and parallel to and resting on the top surface of the polishing pad;

wherein the material used in the construction of the device is three polycarbonate sheets, and wherein the device is resting on the top surface of the polishing pad, coupled to a stainless steel rod, wherein the stainless steel rod is coupled to a beam of the chemical mechanical polishing tool with a spring and a collar such that a load on the device is set at 3 pounds and wherein the device is attached to the rod such that it gimbals freely in terms of bank and pitch angles to the extent permitted by the top surface of the polishing pad but does not rotate in the horizontal plane, and wherein a chemical mechanical polishing slurry or components thereof are introduced by gravity flow through an opening in a top surface of the injector, wherein the opening in the top surface of the injector is positioned at a radius of the polishing pad at which the polishing pad has the greatest contact time with the semiconductor wafer, and wherein the chemical mechanical polishing slurry or components thereof travel though a channel to the injector bottom surface, and wherein the chemical mechanical polishing slurry or components thereof exit the device through 68 openings in the injector bottom surface, wherein the 68 openings are positioned along a curvilinear line paralleling the concave trailing edge at variable spacings corresponding to one or more than one pad land areas on the polishing pad, and wherein the chemical mechanical polishing slurry or components thereof are spread into a thin film and introduced between the top surface of the polishing pad and the semiconductor wafer along a leading edge of the semiconductor wafer in a quantity such that all or most of the slurry or components thereof is introduced between the semiconductor wafer and the top surface of the polishing pad.

10. A method for injecting slurry between a wafer and a polishing pad during chemical mechanical polishing of a semiconductor wafer, the method comprising:

polishing a semiconductor wafer with an apparatus, the apparatus comprising:

a solid crescent-shaped injector comprising:

an injector bottom surface comprising multiple injector bottom surface openings, wherein the injector bottom surface faces a polishing pad top surface, and wherein the injector bottom surface rests on the polishing pad top surface; and an injector concave trailing edge, wherein the injector concave trailing edge is fitted to the size and shape of a leading edge of a polishing head of a chemical mechanical polishing tool with a gap of up to 1 inch between the injector concave trailing edge and the leading edge of the polishing head;

wherein a chemical mechanical polishing slurry or components thereof are introduced through one or more than one injector top surface opening, travel through a channel in the injector, exit the injector through the multiple injector bottom surface openings onto the polishing pad top surface, are spread into a thin film, and are introduced between the top surface of the polishing pad and the semiconductor wafer along a leading edge of the semiconductor wafer in quantities small enough that most of the slurry is introduced between the semiconductor wafer and the polishing pad; and wherein the injector device is attached to a rod with a spring and a collar to assure contact with the polishing pad top surface, and wherein the injector device is gimbaled so that it moves freely to the extent permitted by the polishing pad top surface.

11. The method of claim 10, wherein the material used for the construction of the injector comprises three layers of hard plastic sheet.

12. The method of claim 10, wherein the flow rate of the slurry from the one or more than one injector top surface opening to the multiple injector bottom surface openings is controlled by gravity feed.

13. The method of claim 10, wherein the flow rate of the slurry from the one or more than one injector top surface opening to the multiple injector bottom surface openings is controlled by pumping at a controlled rate.

14. The method of claim 10, wherein the number of injector top surface openings is equal to one.

15. The method of claim 14, wherein the one injector top surface opening is located at a radius from a center of the polishing pad at which the polishing pad top surface has the greatest contact time with the wafer.

16. The method of claim 10, wherein the multiple injector bottom surface openings are placed in a curvilinear pattern, wherein the pattern of the multiple injector bottom surface openings is parallel to the injector trailing edge, and wherein the multiple injector bottom surface openings are spaced to align with one or more than one land areas on the polishing pad.

17. The method of claim 16, wherein the number of multiple injector bottom surface openings is 68.

18. A method of polishing a semiconductor wafer with a chemical mechanical polishing tool comprising:

injecting slurry between the semiconductor wafer and a polishing pad of the chemical mechanical polishing tool with a device, wherein the device comprises:

a solid crescent shaped injector, wherein the solid crescent shaped injector comprises:

a concave trailing edge, wherein the concave trailing edge is fitted to the size and shape of a leading edge of a polishing head of the chemical mechanical polishing tool, with a gap of ½ inch between the concave trailing edge and the leading edge of the polishing head; and an injector bottom surface, wherein the injector bottom surface faces a top surface of the polishing pad, and wherein the injector bottom surface is essentially flat and parallel to and resting on the top surface of the polishing pad;

wherein the material used in the construction of the device is three polycarbonate sheets, and wherein the device is resting on the top surface of the polishing pad, coupled to a stainless steel rod, wherein the stainless steel rod is coupled to a beam of the chemical mechanical polishing tool with a spring and a collar such that a load on the device is set at 3 pounds and wherein the device is attached to the rod such that it gimbals freely in terms of bank and pitch angles to the extent permitted by the top surface of the polishing pad but does not rotate in the horizontal plane, and wherein a chemical mechanical polishing slurry or components thereof are introduced by gravity flow through an opening in a top surface of the injector, wherein the opening in the top surface of the injector is positioned at a radius of the polishing pad at which the polishing pad has the greatest contact time with the semiconductor wafer, and wherein the chemical mechanical polishing slurry or components thereof travel though a channel to the injector bottom surface, and wherein the chemical mechanical polishing slurry or components thereof exit the device through 68 openings in the injector bottom surface, wherein the 68 openings are positioned along a curvilinear line paralleling the concave trailing edge at variable spacings corresponding to one or more than one pad land areas on the polishing pad, and wherein the chemical mechanical polishing slurry or components thereof are spread into a thin film and introduced between the top surface of the polishing pad and the semiconductor wafer along a leading edge of the semiconductor wafer in a quantity such that all or most of the slurry or components thereof is introduced between the semiconductor wafer and the top surface of the polishing pad.

19. An injector device for injecting slurry between a semiconductor wafer and a polishing pad of a chemical mechanical polishing tool, the injector device comprising:

an injector top surface, wherein the injector top surface comprises an injector top surface opening;

an injector bottom surface, wherein the injector bottom surface rests on the polishing pad, and wherein the injector bottom surface comprises multiple injector bottom surface openings in fluid communication with the injector top surface opening.

20. The device of claim 19, wherein each of the multiple injector bottom surface openings align with one of a plurality of land areas on the polishing pad.

21. The device of claim 19, further comprising a channel, wherein the multiple injector bottom surface openings are in fluid communication with the injector top surface opening through the channel.

* * * * *